US005711528A

United States Patent [19]

Pan

[11] Patent Number: 5,711,528

[45] Date of Patent: Jan. 27, 1998

[54] BASEBALL DART BOARD

[76] Inventor: Francis Pan, No. 7, Tatun 15th St., Taichung, Taiwan, Taiwan

[21] Appl. No.: 686,111

[22] Filed: Jul. 24, 1996

[51] Int. Cl.[6] ..... F41J 5/02

[52] U.S. Cl. ..... 273/371

[58] Field of Search ..... 273/371, 374, 273/376, 148 B, 408, 409; 463/36; 364/411, 410; D21/6

[56] References Cited

U.S. PATENT DOCUMENTS

| | | | |
|---|---|---|---|
| D. 271,890 | 12/1983 | Astwood, Sr. | D21/6 |
| D. 329,469 | 9/1992 | Franklin | D21/6 |
| 4,893,822 | 1/1990 | Lesa et al. | 273/376 |
| 5,005,842 | 4/1991 | Bauer | 273/408 |
| 5,054,792 | 10/1991 | Danielson | 273/408 |

*Primary Examiner*—Jessica Harrison
*Assistant Examiner*—Michael O'Neill
*Attorney, Agent, or Firm*—William E. Pelton

[57] ABSTRACT

A kind of dart board with a baseball game effect is proposed. The dart board is composed of a plurality of target areas being configured as a baseball field and which are grouped into three main regions of play. A control panel is disposed below the target area and a control circuit provided within the target areas. The control panel has two sets of indicators which show scores, a switch key for switching the competition sides, a selection key for selecting whether one or two players are participating, a set key for setting the innings number, a pilot lamp configured as an infield of the baseball ground for indicating the baserunning and an indicator light composed of a group of lamps for indicating the put-out number. Two sets of flashers are respectively provided on the two sets of indicators for presenting a blinder light to prompt the defense to throw a dart when appropriate.

4 Claims, 3 Drawing Sheets

BASEBALL DART BOARD

BACKGROUND OF THE INVENTION

1. Field of the Invention

The present invention relates to a dart board, and more particularly to a baseball dart board.

2. Description of Related Art

A conventional darts game is generally played in a manner of setting scores according to the hit position on the target. The target used generally has a certain pattern on the surface thereof and only can provide a single and simple game mode. As people require new and more stimulating games, this kind of darts has become both unsatisfactory and unattractive. Therefore, it is necessary to develop more complex kind of game to meet the desires of people.

The present invention provides a baseball dart board to mitigate and/or obviate the aforementioned problems.

SUMMARY OF THE INVENTION

One object of the present invention is to provide a dart board which is configured as a baseball field and with which players may vividly imitate a baseball game by throwing darts.

The dart board includes a plurality of target areas and those areas are substantially grouped into three regions, Region A, Region B, and Region C. Those target areas may be of different colors so as to be distinguishable is disposed at appropriated points on the dart board.

Another object of the present invention is to provide a dart board with a baseball game effect wherein if two people play, the player whose turn it is next to throw can be determined.

A further object of the present invention is to provide a dart board with a baseball game effect wherein there is provided two sets of indicators which show scores of players, a switch key for switching the batting player, a selection key for selecting between if one or two players are participating, a pilot lamp for indicating the base running and an indicator lamp for indication the put out number.

A further aspect is to provide a dart board with a baseball game effect wherein two sets of flashers are respectively provided at an upper left hand side and a center of each indicator to present a blinder light to prompt the defending player to throw a dart.

Other objects, advantages and novel features of the invention will become more apparent from the following detailed description when taken in conjunction with the accompanying drawings.

DETAILED DESCRIPTION OF PREFERRED EMBODIMENT

Figure 1:
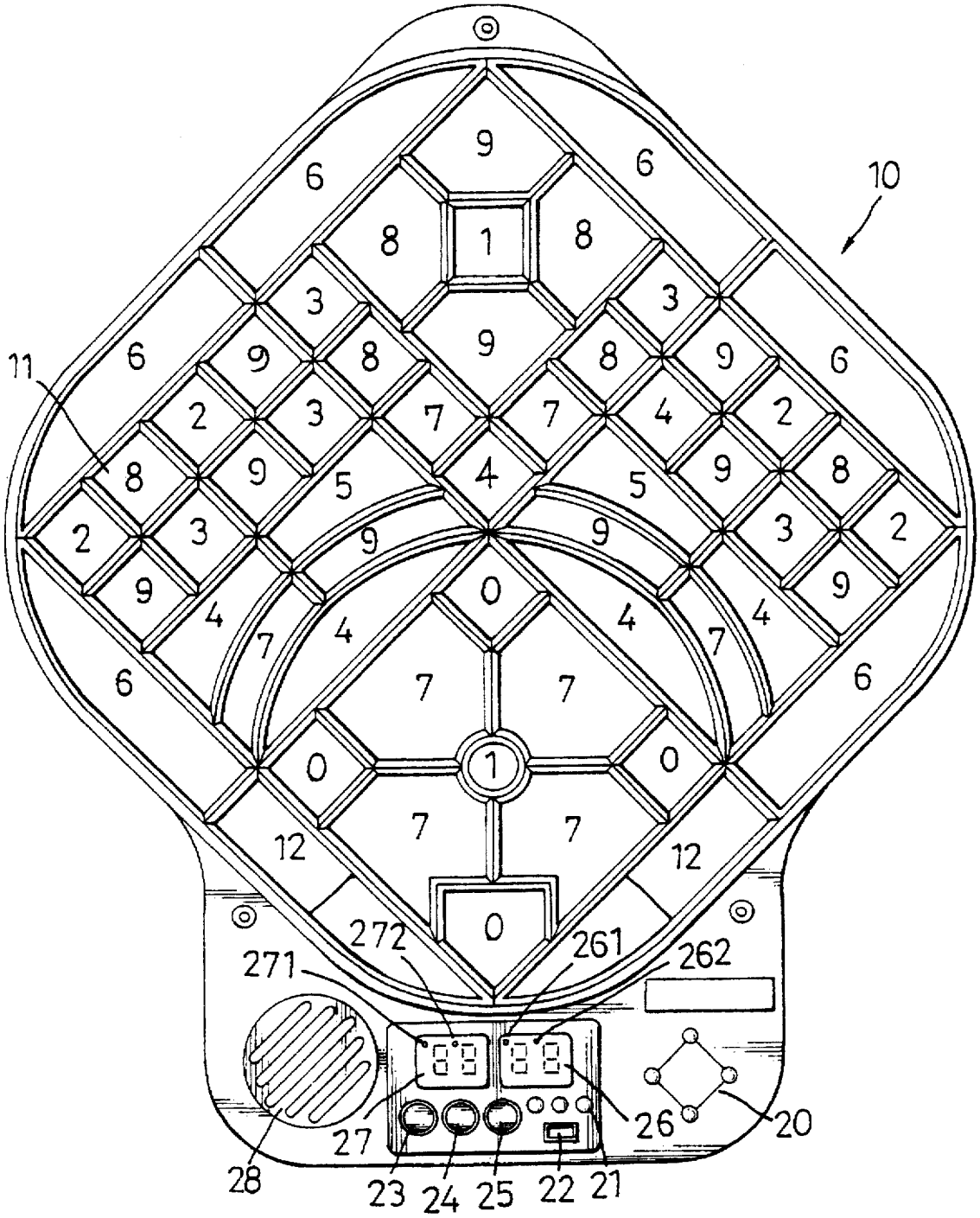
FIG. 1 is a schematic view showing a front face of the target in accordance with the present invention.

Referring initially to FIG. 1, a dart board with a baseball game effect in accordance with the present invention comprises a target 10 composed of a plurality of target areas 11.

The plurality of targets areas 11 are formed in various colors so as to be distinguishable from each other. Beneath each target area 11 there is provided a pressure sensitive pad (not numbered) for transferring signals to a control circuit disposed within the target 10 after detecting a target area has been hit. Below the target 10 there is provided a loudspeaker 28, a pair of indicators 26, 27 to indicate of scores of players, a switch key 23 for switching the competition sides, a selection key 24 for selecting between participation of one player or two players, and a set key 25 for setting the innings number. Therefore, with the control circuit in the target 10, an automatic scoring can be obtained during the darts game. Since above-mentioned elements are of prior arts, detailed description is omitted.

In accordance with one aspect of the present invention, a dart board with baseball game effect is proposed. From the FIG. 1, the target 10 is composed of a plurality of target areas 11. The plurality of targets areas 11 are configured as a baseball field, i.e. the areas 11 are arranged in the forms of infield, shortstop area, outfield, territory, etc. of the baseball competition ground. A pair of color reference tables 12 is disposed below respective sides of the target 10, illustrative of the meanings of various colors of the areas. For example, in this case, the various colors of the areas 11 are not able to be shown in the Figs so that a set of numerals (e.g. from 0 to 9) are used for illustration. In this embodiment, numeral 1 indicates "home run", numeral 2 indicates "three-base hit", numeral 3 indicates "two-base hit", numeral 4 indicates "one-base hit", numeral 5 indicates "base on balls", numeral 6 indicates "put-out", numeral 7 indicates "grounder/roller force-out, putout", numeral 8 indicates "bloop hit/bloop assist", numeral 9 indicates "strikeout" and numeral 0 indicates "put-out/assist". As in a baseball competition, the above-mentioned target areas 11 are summarized as the following three regions, that is, the absolute batter's box (which includes each-base hit, the home run, the base on balls, etc.), the absolute blocking area (which includes the strikeout, the putout, the forceout, foul assist, etc.) and the undetermined area (which includes bloop hit or the grounder, etc.). Wherein the ball running or the put-out are determined by two players changing sides and hitting at the undetermined area. Thereby, the dart board 10 can simulate a baseball game.

Figure 2:
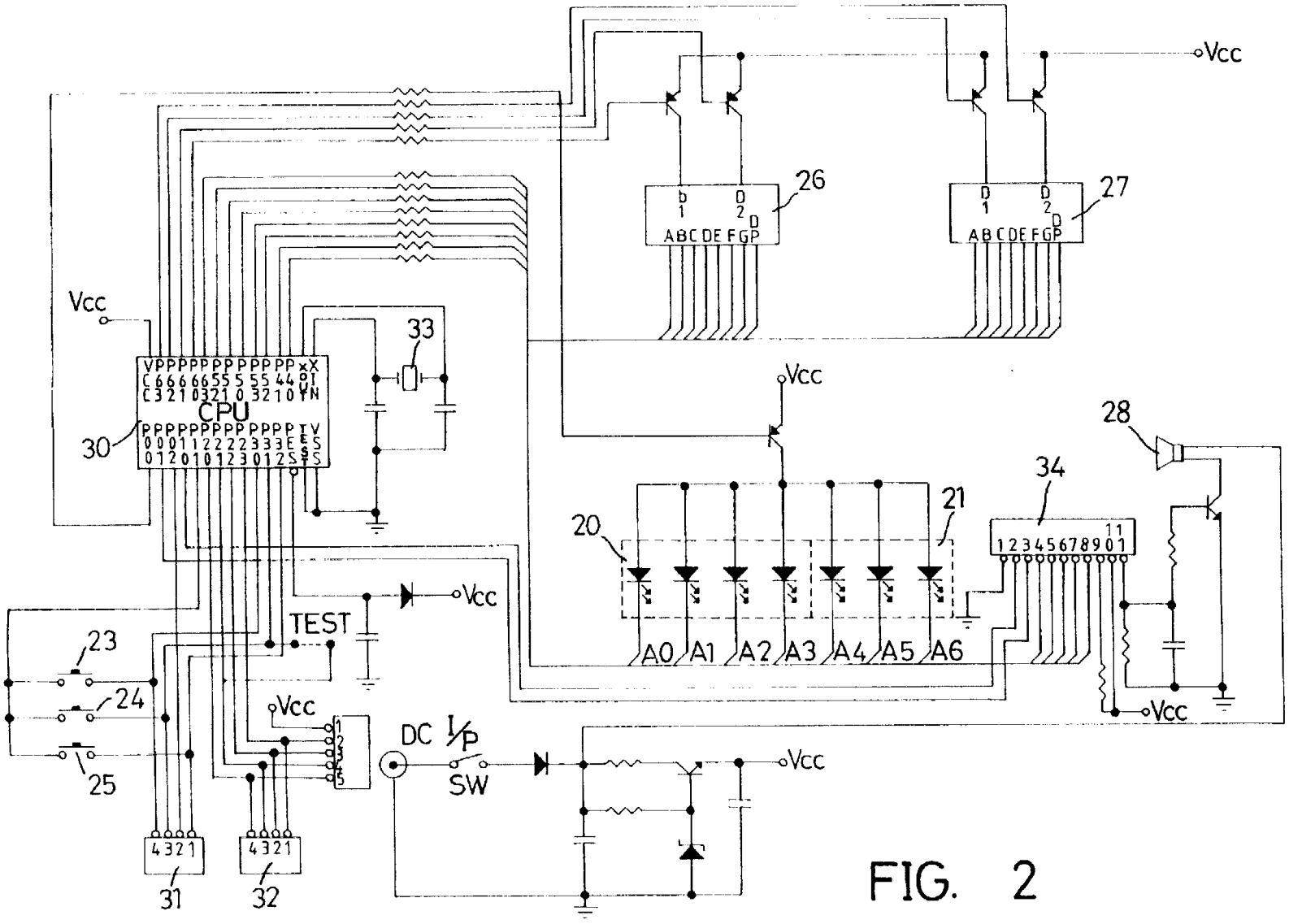
FIG. 2 is a circuit diagram showing the control circuit disposed within the target in accordance with the present invention.

Still referring to FIG. 2, below the target 10 there is further provided a pilot lamp 20 configured as an infield of the baseball ground for indicating the baserunning and an indicator light 21 composed of three lamps arranged transversely for indicating the put-out number. Also, two pairs of flashers 261, 262, 271, 272 are respectively provided at an upper left hand side and a center of the each set of the indicators 26, 27 for presenting a blinder light when the undetermined area on the target is hit and prompting the defense to throw a dart.

The control circuit of this invention is disposed within the target. FIG. 2 shows a circuit diagram of the control circuit in accordance with the present invention. The control circuit comprises a central process unit (CPU) 30 and a quartz oscillator 33, as shown in the left of the FIG. 2. The CPU 30 has a plurality of output ports, three of which are respectively connected with the switch key 23 for switching the competition sides, the selection key 24 for selecting between participation of one player or two players, and the set key 25 for setting the innings number. The three output ports of the CPU 30 are further connected to the tablet of the target via a pair of connector 31 and 32 so that the CPU can operate after the tablet detects a target has been hit. The CPU further has a plurality of input ports, several of which are respectively connected with the pair of indicators 26, 27 indicative of scores, an indicator light 21 composed of a group of lamps for indicating the put-out number, a pilot lamp 20 configured as an infield of the baseball ground for indicating the baserunning, and a voice-integrated circuit 34 for generating sound during the game.

Figure 3:
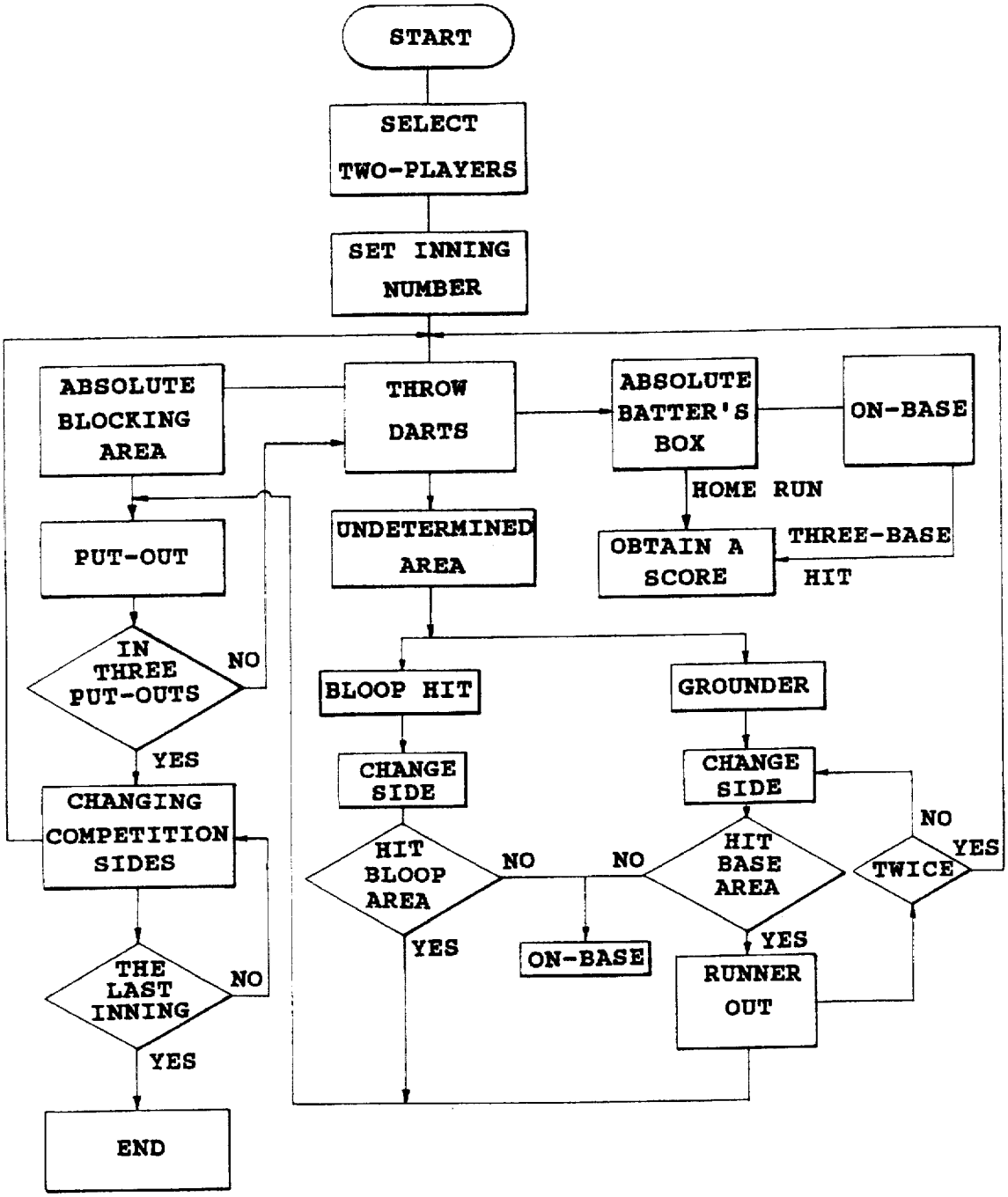
FIG. 3 is a flow-process diagram showing operation of the darts in accordance with the present invention.

The game method in accordance with the present invention is shown in FIG. 3, which is a flow-process diagram showing operation of the darts in accordance with the present invention. Since the difference between one player and two players is that the undetermined area being hit is determined as put-out during a one-player game and is determined as a sides change during a two-player game, the two-player game is now taken for example. As shown in FIG. 3, after powering up, the players may press down the selection key 24 to select a two-players game mode and press down the set key 25 to set the innings number. Then the players in turn can start to throw darts. If one player hits the target 10 at the absolute batter's box, the result is considered as the one, two and three-base hit, the home run, or the base on balls and a base entering, a base running and a score are permitted and obtained. If one player hits the target 10 at the absolute blocking area, the result is considered as the put-out and a determination is carried out to determine whether there are three put-out team members. If yes, the first inning is ended and the competition sides are changed by pressing the switch key 23 on the target 10 for the next inning. When the innings reach the setting number, then the game is over. If one player hits the target 10 at the undetermined area, the result is considered as a bloop hit or a grounder and the competition sides should be changed. After changing sides, If the offensive player hits the bloop hit area (bloop hit) or the base area (grounder), the result is considered as a put-out, or will be considered as a beat out. Additionally, in the case of a single player game, the undetermined area is canceled, that is, if the player hits the bloop hit area (bloop hit) or the base area (grounder), the result is considered as a put-out, without a side change. Accordingly, the darts game can vividly imitate a baseball game.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dart board with a baseball game effect comprising:

a target composed of a plurality of target areas, said plurality of targets area being configured as a baseball field and grouped into three regions which are absolute batter's box, absolute and undetermined area, respectively;

a control panel disposed below the target; and a control circuit provided within the target.

2. A dart board with a baseball game effect as claimed in claim 1, wherein on the control panel there is provided two sets of indicators showing scores, a switch key for switching the competition sides, a selection key for selecting between participation of one player or two players, a set key for setting the innings number, a pilot lamp configured as an infield of the baseball ground for indicating the baserunning and an indicator light composed of a group of lamps for indicating the put-out number.

3. A dart board with a baseball game effect as claimed in claim 1, wherein the control panel further comprises two sets of flashers respectively provided on the two sets of indicators for presenting a blinder light when the undetermined area on the target is hit to prompt the defense to throw a dart.

4. A dart board with a baseball game effect as claimed in claim 1, wherein each of the plurality of target areas may be of different colors so as to be distinguishable from each other, and wherein at least one color reference table is disposed at an appropriate position on the target.

* * * * *